US009027210B2

(12) United States Patent
Peters et al.

(10) Patent No.: US 9,027,210 B2
(45) Date of Patent: May 12, 2015

(54) SELF-ALIGNING ZIPPER

(75) Inventors: Scott Lawrence Peters, Pittsford, NY (US); David Whitney Lyndaker, Holley, NY (US); Nancy Elizabeth Peters, Akron, NY (US)

(73) Assignee: DNS Designs, LLC, Pittsford, NY (US)

( * ) Notice: Subject to any disclaimer, the term of this patent is extended or adjusted under 35 U.S.C. 154(b) by 334 days.

(21) Appl. No.: 13/608,469

(22) Filed: Sep. 10, 2012

(65) Prior Publication Data

US 2013/0061436 A1 Mar. 14, 2013

Related U.S. Application Data

(60) Provisional application No. 61/533,774, filed on Sep. 12, 2011.

(51) Int. Cl.

| | |
|---|---|
| ***A44B 19/40*** | (2006.01) |
| ***A44B 99/00*** | (2010.01) |
| ***A44B 19/38*** | (2006.01) |
| ***A44B 19/24*** | (2006.01) |

(52) U.S. Cl.

CPC ..... *A44B 19/24* (2013.01); *Y10T 24/2588* (2015.01); *Y10T 24/32* (2015.01); *Y10T 24/2593* (2015.01); *A44D 2203/00* (2013.01); *A44B 19/388* (2013.01); *A44B 99/00* (2013.01)

(58) Field of Classification Search

CPC ..... A44B 19/24; A44B 19/388; A44B 19/34; A44D 2203/00; Y10T 24/2588; Y10T 24/2593; Y10T 24/32

USPC ..... 24/303, 433, 434

See application file for complete search history.

(56) References Cited

U.S. PATENT DOCUMENTS

| | | | | | |
|---|---|---|---|---|---|
| 2,615,227 | A | * | 10/1952 | Hornik | 24/303 |
| 2,648,884 | A | * | 8/1953 | Loofboro | 24/303 |
| 3,324,521 | A | * | 6/1967 | Humiston | 24/303 |
| 3,583,041 | A | | 6/1971 | Horwitt | |
| 4,231,137 | A | * | 11/1980 | Fujimoto | 24/303 |
| 4,232,430 | A | | 11/1980 | Friedberg | |
| 5,412,849 | A | | 5/1995 | Fudaki | |
| 5,791,023 | A | | 8/1998 | Comerford | |
| 6,026,547 | A | | 2/2000 | O'Donnell | |

(Continued)

FOREIGN PATENT DOCUMENTS

| | | | |
|---|---|---|---|
| JP | 2004-248809 | A | 9/2004 |
| JP | 2005-246006 | A | 9/2005 |

(Continued)

OTHER PUBLICATIONS

PCT International Search Report and Written Opinion for International Application No. PCT/US 2010/038538; Date of Mailing Mar. 17, 2011. 11 pages.

*Primary Examiner* — Robert J Sandy

(74) *Attorney, Agent, or Firm* — Patent Technologies, LLC; Robert D. Gunderman, Jr.

(57) ABSTRACT

A Self-Aligning Zipper is disclosed that allows for one handed operation by anyone who would, otherwise use a zipper or use of the Self-Aligning Zipper by those with physical and developmental limitations or equipment such, as cold weather gloves or mittens. The proper alignment of each half of the Self-Aligning Zipper is accomplished by way of magnets of opposite polarity along with structural guide elements to ensure proper alignment and operation of the zipper.

33 Claims, 20 Drawing Sheets

(56) References Cited

U.S. PATENT DOCUMENTS

| | | | | |
|---|---|---|---|---|
| 6,088,888 | A | 7/2000 | Oda | |
| 6,826,810 | B2 | 12/2004 | Ichikawa et al. | |
| 6,857,169 | B2 * | 2/2005 | Chung | 24/303 |
| 7,036,192 | B2 | 5/2006 | Yoneoka | |
| 2005/0050699 | A1 | 3/2005 | Yoneoka | |

FOREIGN PATENT DOCUMENTS

| | | | |
|---|---|---|---|
| JP | 2007-229411 | A | 9/2007 |
| KR | 2008-0002727 | U | 7/2008 |

* cited by examiner

SELF-ALIGNING ZIPPER

CROSS REFERENCE TO RELATED PATENT APPLICATIONS

This application claims priority to U.S. patent application Ser. No. 61/533,774 filed Sep. 12, 2011 entitled "Self-Aligning Zipper" by Peters et al. The disclosure of this U.S. patent application Ser. No. 61/533,774 is incorporated herein by reference in its entirety.

BACKGROUND OF THE INVENTION

1. Field of the Invention

The present invention relates generally to fastening devices, and more particularly to a Self-Aligning Zipper that allows for alignment and closure with one hand.

2. Description of Related Art

The common zipper was invented more than 100 years ago. In 1851, Elias Howe, who also invented the sewing machine, received U.S. Pat. No. 8,540 for an "Automatic Continuous Clothing Closure." Through lack of marketing, Howe's closure device gained little acceptance. Years later, Whitcomb Judson marketed a "Clasp Locker" (U.S. Pat. Nos. 504,038 and 504,037) and started the Universal Fastener Company, but the product again met with little commercial success. Then in 1906 Gideon Sundbäck, a Swedish-American electrical engineer, was hired by the Universal Fastener Company. In 1913 he had designed what has come to be known as the modern zipper. The patent for his "Separable Fastener" was issued in 1917 as U.S. Pat. No. 1,219,881.

The term "Zipper", however, was popularized by the B.F. Goodrich Company when they used Sundbäcks fastener on a new type of rubber boots. For nearly twenty years, the zipper was used primarily for rubber boots and closures on tobacco pouches. It was not until the 1930's that the zipper became popular on garments. Today the zipper is by far the most popular fastener. The zipper is found on clothing such as jackets, luggage, bags, camping equipment, and many other objects. Zippers can be found on all types of clothing such as pants, dresses, and jackets, on carriers such as bags and luggage, and in gear such as sleeping bags and tents. In addition to serving as decoration, zippers can join together two sides of a garment, such as in the operation of a dress, and can serve as means to removably attach two pieces of fabric, such as in the attachment of a removable hood to a jacket.

Fastening devices such as zippers can be separating or non-separating, and can be one-way or two-way devices. In a separating zipper, each of the two zipper tracks, comprising the tape and attached teeth, are connected to different elements that are primarily joined only by the interlocking zipper teeth. In a non-separating zipper, both zipper tracks are connected to a single element such that interlocking and unlocking the zipper teeth creates an opening in that element. A two-way zipper comprises two slider bodies that can work together or separately to interlock and unlock the zipper teeth. A one-way zipper comprises a single slider body as well as a pin and box assembly that aligns the zipper teeth contained on at least one of the zipper tracks.

In their simplest form, one-way separating zippers are composed of relatively few parts, including: an origination assembly with a pin and a retainer body at the lower limit of each row of zipper teeth; two pieces of tape that are attached to fabric on one side and contain zipper teeth on the other; a slider body with a pull-tab; and two top stops at the upper limit of each row of teeth.

To fasten two pieces of fabric together, the operator inserts the pin from the lower limit of one row of teeth into the retainer box at the matching lower limit of the other row of teeth. This aligns the teeth into an operable interlocking format. Once aligned, the operator pulls the latching mechanism, called the slider body, along the teeth track. Wedges inside the slider body force the teeth of each track to interact. If the teeth are aligned, the hook of each tooth settles into the hollow of an opposing tooth. The operator can continue to pull the slider body and interlock the teeth until the slider terminates at the top stops located at the upper limit of each row of teeth.

To unfasten the pieces of fabric, the operator pulls the slider body back along the closed track. The wedges inside the slider body force the interlocking teeth apart and separate the zipper closure.

Despite the ease with which zipper-type closures operate, many individuals encounter difficulty joining together the pin and body. Others may have difficulty grasping the small slider body or pulling it along the zipper's teeth. Examples of individuals who often encounter these difficulties include small children, people wearing gloves for protection, elderly, and people with poor vision, macular degeneration, or cataracts. Additionally, people with disabilities such as arthritis, multiple sclerosis, cerebral palsy, pervasion developmental disorders, Down's syndrome, ataxia, diabetes with neuropathy, stroke (CVA), paraplegics, Lou Gehrig's Disease, Parkinson's, and other ailments can also find the operation of zippers to be difficult.

There has been very little advancement in technologies relating to zippers since their first introduction more than 100 years ago. U.S. Pat. No. 8,146,214 to Peters et al. describes a zipper that is improved over the basic zipper design of Gideon Sundbäck, the entire disclosure of this published application, and any and all continuations, divisionals, continuations in part, and issued patents resulting therefrom being incorporated herein by reference in their entirety.

It is therefore an object of the present invention to provide an improved zipper that allows for easy alignment and closure, it is another object of the present invention to provide an improved zipper for one handed operation. It is another object of the present invention to provide an improved zipper for use by individuals with limited dexterity. It is another object of the present invention to provide an improved zipper that can be used while wearing gloves or mittens. It is yet another object of the present invention to provide an improved zipper that can be operated easily by small children. These and other objects of the present invention are not to be considered comprehensive or exhaustive, but rather, exemplary of objects that may be ascertained after reading this specification with the accompanying drawings and claims.

BRIEF SUMMARY OF THE INVENTION

In accordance with the present invention, there is provided a fastening device, the fastening device comprising a first lower body having a first magnet, a male retention element and a first extension; a second lower body having a second magnet, a female retention element and a second extension; the female retention element of the second lower body having a notch to receive the male retention element of the first lower body and an angled face to guide the female retention element of the second lower body into proper alignment with the male retention element of the first lower body through the attractive force of the first magnet and the second magnet.

The foregoing paragraph has been provided by way of introduction, and is not intended to limit the scope of the invention as described by this specification, claims and the attached drawings.

BRIEF DESCRIPTION OF THE DRAWINGS

The invention will be described by reference to the following drawings, in which like numerals refer to like elements, and in which.

Figure 1:
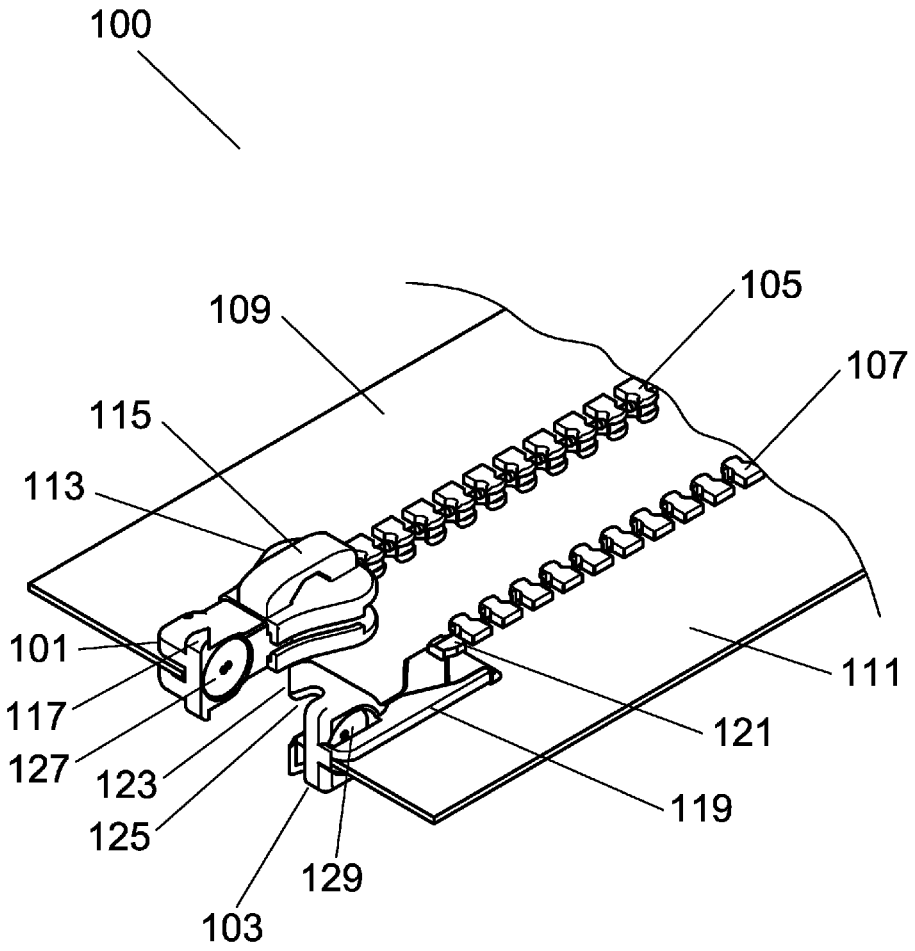
FIG. 1 is a perspective view of the Self-Aligning Zipper prior to joining.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, claims and the attached drawings.

DESCRIPTION OF THE PREFERRED EMBODIMENTS

For a general understanding of the present invention, reference is made to the drawings. In the drawings, like reference numerals have been used throughout to designate identical elements.

The present invention will be described by way of example, and not limitation. Modifications, improvements and additions to the invention described herein may be determined after reading this specification and viewing the accompanying drawings; such modifications, improvements, and additions being considered included in the spirit and broad scope of the present invention and its various embodiments described or envisioned herein.

Referring to the present invention in detail, in FIG. 1 there is shown a perspective view of the Self-Aligning Zipper prior to joining. The proper alignment of each half of the zipper is accomplished by way of magnets of opposite polarity along with structural guide elements to ensure proper alignment of the zipper such that the zipper may be closed with one hand or by an individual with limited physical capabilities. The Self-Aligning Zipper 100 can be seen in FIG. 1 along with a first lower body 101 and a second lower body 103. The first lower body 101 has a first magnet 127 and a male retention element 137. The male retention element 117 can be seen as a tab or protrusion on each side of the first lower body 101. The male retention element 117 and the related notch of the female retention element 125 may be generally triangular, or in some embodiments of the present invention, may be rounded. The second lower body 103 has a second magnet 129 and a female retention element 125. The female retention element 125 has a notch on either side of the second lower body 103 to receive the male retention element 117 of the first lower body 101 and an angled face 123 to guide the female retention element 125 into proper alignment with the male retention element 117 through the attractive force of the first magnet 127 and the second magnet 129.

Figure 3:
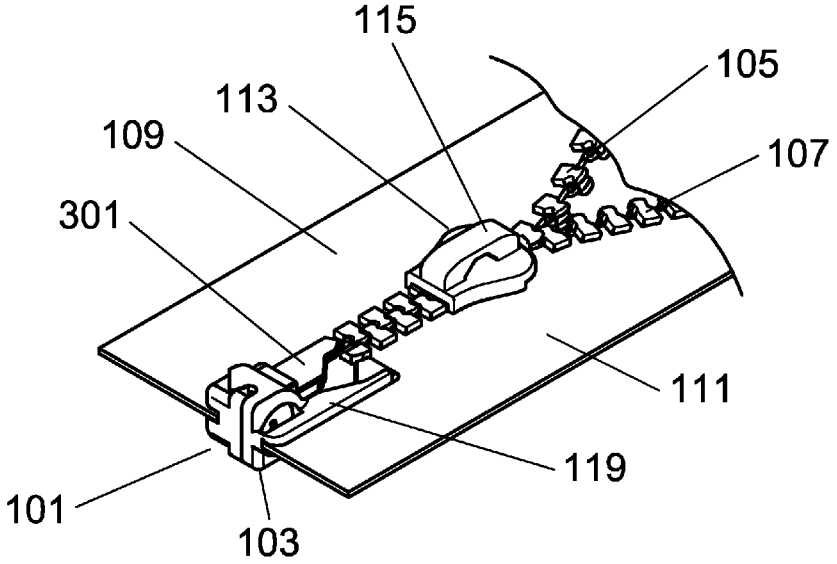
FIG. 3 is a perspective view of the Self-Aligning Zipper during closure.

The fastening device of the present invention comprises a first lower body 101 comprising a first magnet 127, a male retention element 117 and a first extension 301 (see FIG. 3);

a second lower body 103 comprising a second magnet 129, a female retention element 125 and a second extension 119; the female retention element 125 of the second lower body 103 having a notch to receive the male retention element 117 of the first lower body 101 and an angled face 123 to guide the female retention element 125 of the second lower body 103 into proper alignment with the male retention element 117 of the first lower body 101 through the attractive force of the first magnet 127 and the second magnet 129.

Figure 18:
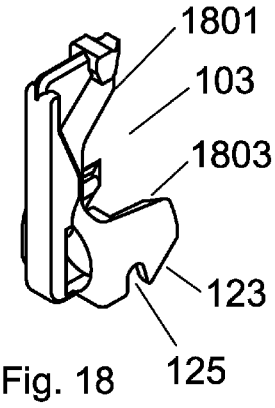
FIG. 18 is a perspective view of the second lower body.
Figure 24:
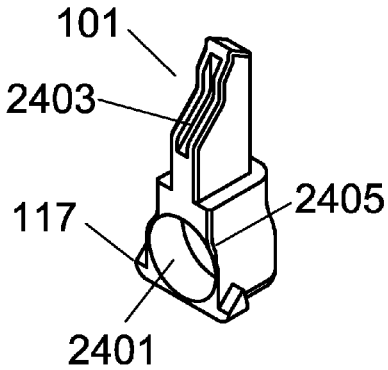
FIG. 24 is a perspective view of the first lower body.

To further assist with alignment and guidance of the Self-Aligning Zipper while in use, several additional alignment features can be seen in FIGS. 18 and 24, and will be further described herein. The first magnet 127 and the second magnet 129 may be ferrite magnets, alnico magnets, rare earth magnets (Neodymium, Samarium-cobalt, for example), or the like. In some embodiments of the present invention, one of the magnets may be replaced with a ferromagnetic material or at least made partly of a ferromagnetic material. In some embodiments of the present invention, the magnet may contain a ferromagnetic layer, plate, or component. Further, in some embodiments of the present invention, the magnets may be electromagnets that utilize a power source such as an energy harvester, a battery, an ultracapacitor, or the like. The electromagnets may further be integrated with smart clothing that contains sensors, processors, or the like. In use, opposite poles face each other to provide an attractive force that serves to draw each zipper half together. In some embodiments of the present invention, the magnets may have keying features machined or otherwise manufactured into the magnets and corresponding keying features in the first lower body and the second lower body to provide retention of the magnet and also ensure that the proper polarity is observed when the magnets are installed into the lower bodies. The magnets may be installed into the lower bodies using adhesives or mechanical attachment techniques or a combination thereof. Mechanical attachment techniques include, but are not limited to, side undercuts, snap features, separate retention parts, keying features on the magnet and the lower body, or the like. The magnets may also be fully encased in the first lower body or the second lower body, or both the first lower body and the second lower body. The first lower body 101 is attached to a first zipper track 105 and the second lower body 103 is attached to a second zipper track 107. Both the first zipper track 105 and the second zipper track may be made using conventional techniques, such as that of plastic molded or metallic teeth construction, coil construction, and the like. The first zipper track 105 is fastened to a first zipper tape 109 using an adhesive, heat, crimping, overmolding, or the like. In a similar way, the second zipper track 107 is fastened to a second zipper tape 111 using an adhesive, heat, crimping, overmolding, or the like. The first zipper tape 109 and the second zipper tape 111 may be made from a material such as nylon webbing, nylon or polyester fabric, or the like. The first zipper tape 109 and the second zipper tape 111 are then used to fasten the Self-Aligning Zipper to two edges of fabric that are to be temporarily joined together by way of the Self-Aligning zipper. Common techniques of fastening the Self-Aligning Zipper to two edges of fabric include adhesives and stitching. The first lower body 101 and the second lower body 103 may be made from a metal such as, for example, steel or brass, or may be made from a plastic such as, for example, polyoxymethylene (also known as acetal, polyacetal, and polyformaldehyde) or polyethylene resin. Other parts of the Self-Aligning Zipper may be made from similar materials. The parts may be injection molded if they are a plastic, or may be cast, machined or stamped if they are a metal. The second lower body also has a second extension 119 that serves to provide structural strength to the overall assembly, and also a starter tooth 121 that begins the second zipper track 107. Located on the first zipper track 105 is a slider body 113 that is similar to the slider bodies used on many common zippers. The slider body 113 has a pull tab 115 for attaching a zipper pull. As can be clearly seen in FIG. 1, the slider body 113 engages with the second zipper track 107 at the starter tooth 121 and at the edge of the second extension 119.

The Self-Aligning Zipper for one handed operation comprises a first lower body 101 comprising a first magnet 127, a male retention element 117 and a first extension 301 (see FIG. 3); a first zipper track 105 having a plurality of teeth and affixed to the first lower body 101; a slider body 113 slidably connected to the first zipper track 105; a second lower body 103 comprising a second magnet 129, a female retention element 125 and a second extension 119; a second zipper track 107 having a plurality of teeth and affixed to the second lower body 103; the female retention element 125 of the second lower body 103 having a notch to receive the male retention element 117 of the first lower body 101 and an angled face 123 to guide the female retention element 125 of the second lower body 103 into proper alignment with the male retention element 117 of the first lower body 101 through the attractive force of the first magnet 127 and the second magnet 129.

In some embodiments of the present invention, the handage of the zipper may be changed by interchanging the appropriate parts from the left side to the right side or from the right side to the left side depending on whether a left handed or a right handed zipper is desired during manufacturing. This would include, for example, placing the slider body 113 on the alternate zipper track, placing a starter tooth on the alternative lower body, and the like.

The engagement of each half of the Self-Aligning Zipper is facilitated by the magnets in each half and the alignment and guidance geometries described herein and depicted in the drawings. To start the fastening process with the Self-Aligning zipper, each zipper half is brought together until the magnets in each half begin to attract each other. As the magnets draw each half together, the alignment and guidance geometries ensure proper alignment and the slider can then be pulled by way of a zipper pull, and the zipper will close.

Figure 2:
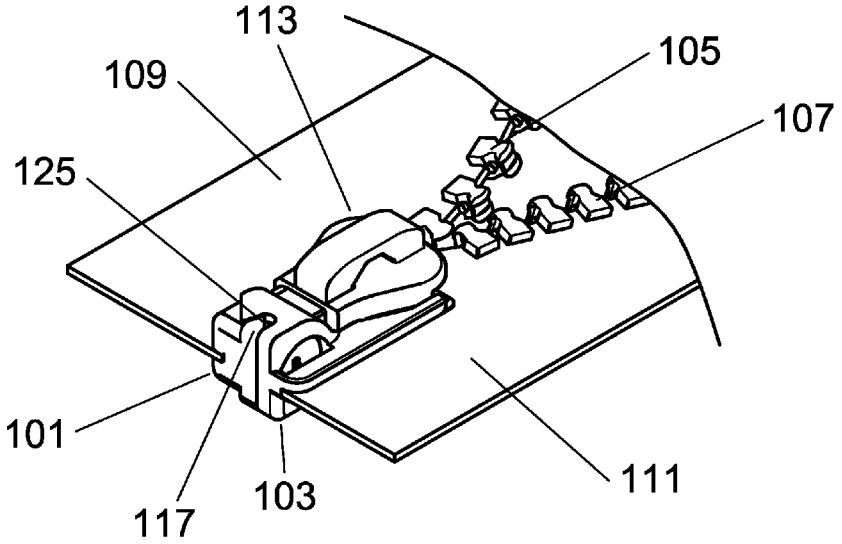
FIG. 2 is a perspective view of the Self-Aligning Zipper once joined.

FIG. 2 is a perspective view of the Self-Aligning Zipper once joined. The male retention element 117 can be seen secured in the female retention clement 125, and the slider body 113 is ready to be drawn along the first zipper track 105 and the second zipper track 107 to close the Self-Aligning Zipper. It should be noted that in some embodiments of the present invention, a male retention element and female retention element are located on each side of the zipper.

FIG. 3 is a perspective view of the Self-Aligning Zipper during closure. A first extension 301 can also now be seen as the slider is not obstructing its view as in FIG. 1. The first extension 301 is attached to the first lower body 101 and provides structural strength and a mating surface. In FIG. 3, the slider body 113 has a pull tab 115 for attaching a zipper pull.

Figure 4:
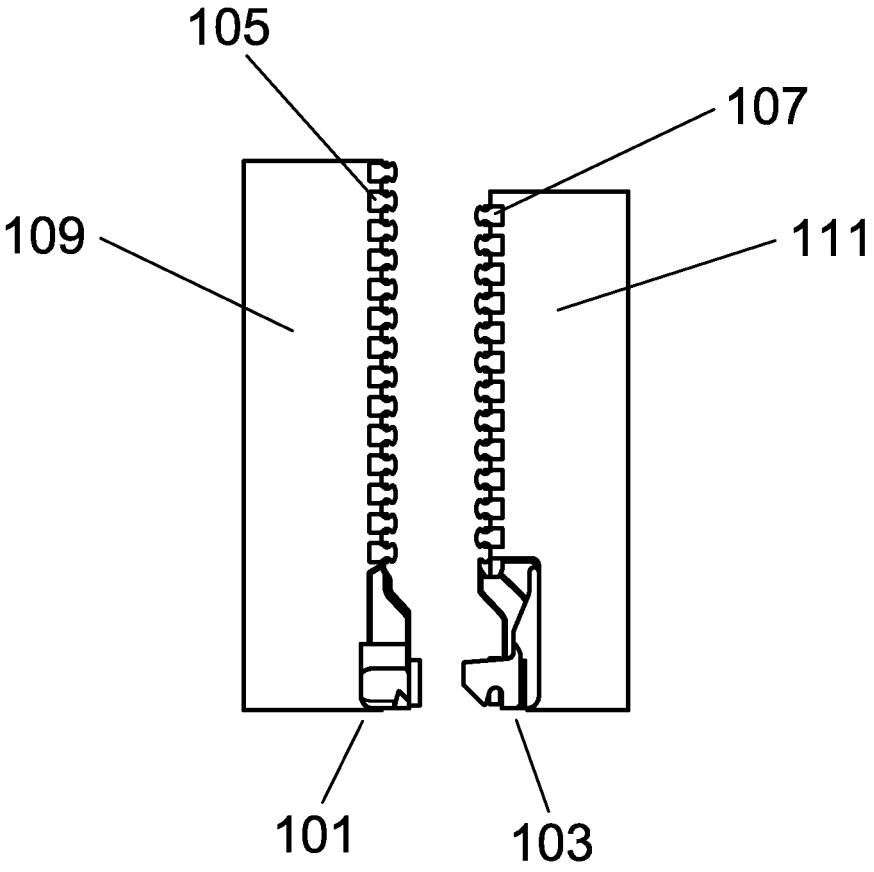
FIG. 4 is a plan view of the Self-Aligning Zipper prior to joining.

FIG. 4 is a plan view of the Self-Aligning Zipper prior to joining. Various zipper pulls may be used with the present invention. FIGS. 5-16 depict three exemplary zipper pulls. Zipper pulls may be made from a metal such as steel or brass, or a plastic such as polyethylene, polypropylene, or the like. Methods of manufacture of zipper pulls include injection molding for plastics, machining, casting, stamping, and the like.

Figure 5:
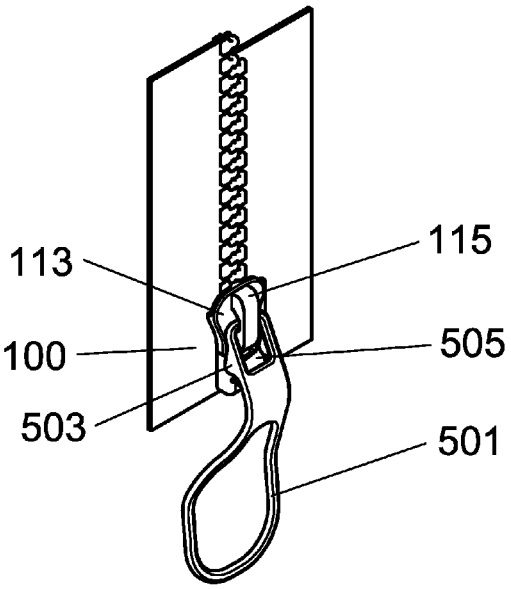
FIG. 5 is a perspective view of the Self-Aligning Zipper with a closed zipper pull.
Figure 6:
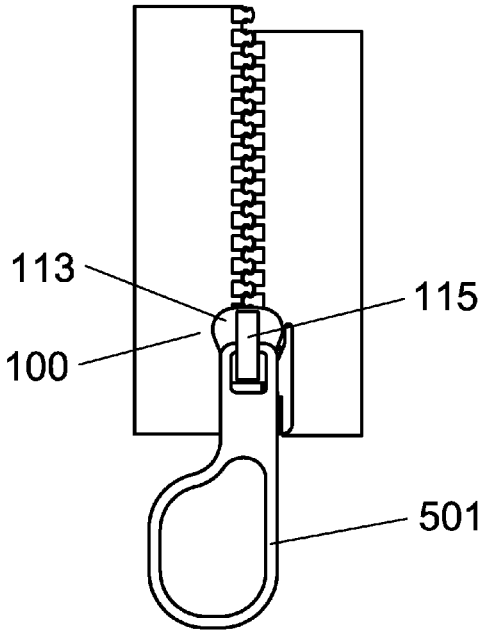
FIG. 6 is a plan view of the Self-Aligning Zipper with a closed zipper pull.
Figure 7:
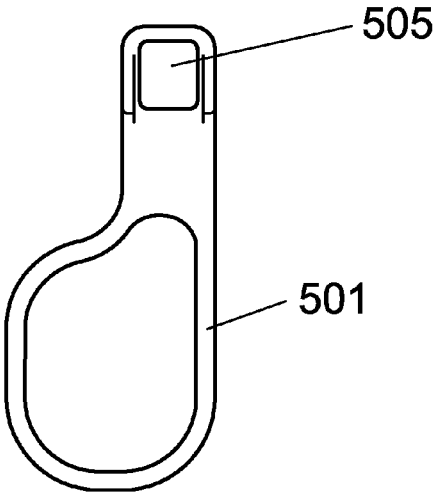
FIG. 7 is a plan view of the closed zipper pull.
Figure 8:
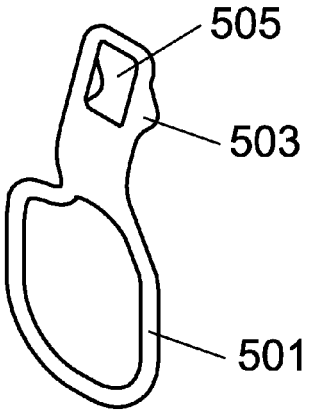
FIG. 8 is a perspective view of the closed zipper pull.
Figure 9:
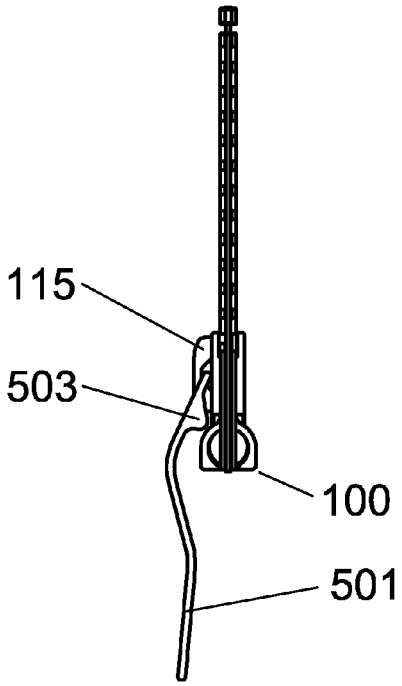
FIG. 9 is a side view of the Self-Aligning Zipper with a closed zipper pull.

FIG. 5 is a perspective view of the Self-Aligning Zipper 100 with a closed zipper pull 501. A retainer 505 can be seen that provides attachment of the closed zipper pull 501 to the pull tab 115 on the slider body 113. Further, a stop 503 can be seen that is a protruding feature on the back side of the closed zipper pull that provides a slight offset to the closed zipper pull in its normal resting position on a garment or object. This allows the closed zipper pull to easily be grasped and operated and also prevents the base lower body from catching on the pull. Further, in some embodiments of the present invention, the closed zipper pull may have a curve or an offset to make it easy to grasp. FIG. 6 is a plan view of the Self-Aligning Zipper with a closed zipper pull. FIG. 7 is a plan view of the closed zipper pull and FIG. 8 is a perspective view of the closed zipper pull that shows a stop 503 on either side of the closed zipper pull. Various geometries and structures may be used as a stop without departing from the spirit and broad scope of the present invention and its various embodiments described and depicted herein. FIG. 9 is a side view of the Self-Aligning Zipper with a closed zipper pull that shows the engagement of the stop 503 with the Self-Aligning Zipper to create a slight offset. The offset serves to provide clearance between the zipper pull and the body of the Self-Aligning Zipper so that the zipper pull does not interfere with the operation of the Self-Aligning Zipper.

Figure 10:
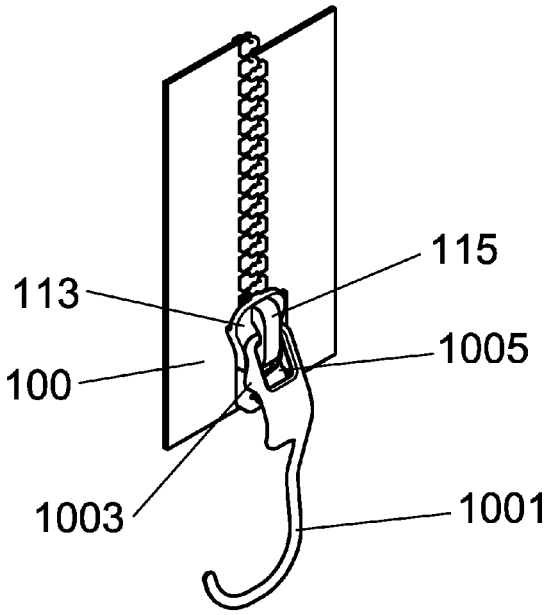
FIG. 10 is a perspective view of the Self-Aligning Zipper with an open zipper pull.
Figure 11:
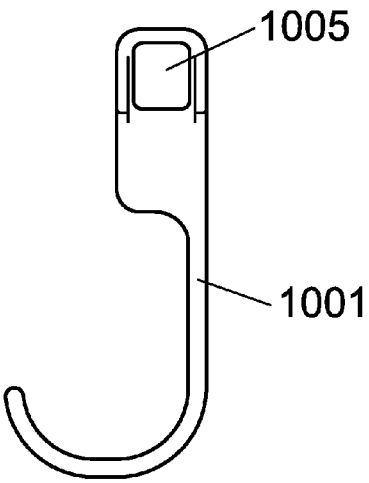
FIG. 11 is a plan view of the open zipper pull.
Figure 12:
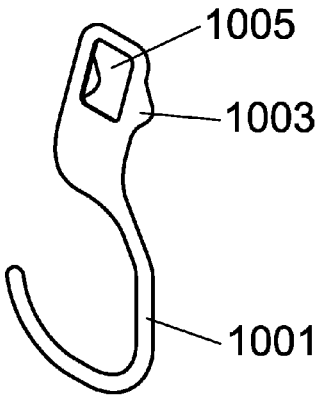
FIG. 12 is a perspective view of the open zipper pull.

In another embodiment of the present invention, an open zipper pull is provided as depicted in FIGS. 10-12. FIG. 10 is a perspective view of the Self-Aligning Zipper with an open zipper pull. A retainer 1005 can be seen that provides attachment of the open zipper pull 1001 to the pull tab 115 on the slider body 113. Further, a stop 1003 can be seen that is a protruding feature on the back side of the open zipper pull that provides a slight offset to the open zipper pull in its normal resting position on a garment or object. This allows the open zipper pull to easily be grasped and operated and prevents the base lower body from catching on the pull. Further, in some embodiments of the present invention, the open zipper pull may have a curve or an offset to make it easy to grasp. FIG. 11 is a plan view of the open zipper pull and FIG. 12 is a perspective view of the open zipper pull that shows a stop 1003 on either side of the open zipper pull. Various geometries and structures may be used as a stop without departing from the spirit and broad scope of the present invention and its various embodiments described and depicted herein.

Figure 13:
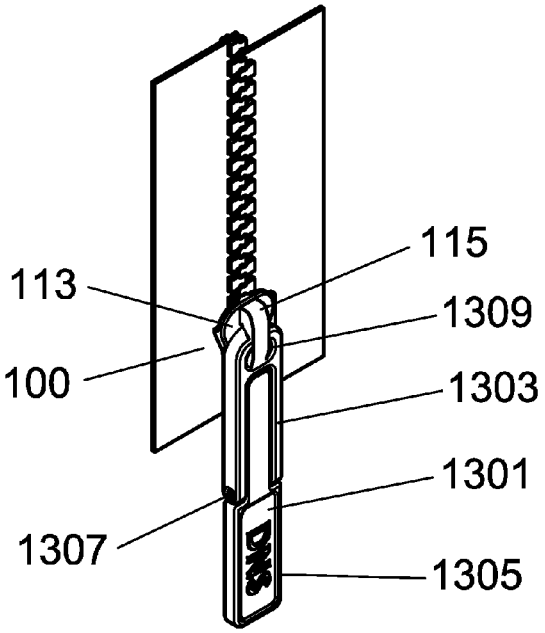
FIG. 13 is a perspective view of the Self-Aligning Zipper with a hinged zipper pull.
Figure 14:
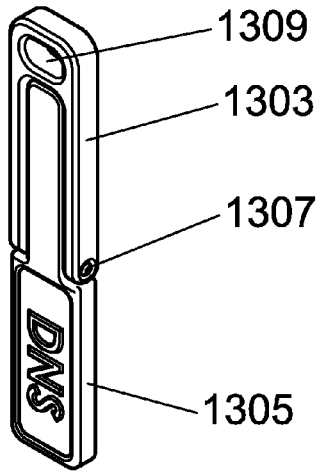
FIG. 14 is a perspective view of the hinged zipper pull.
Figure 15:
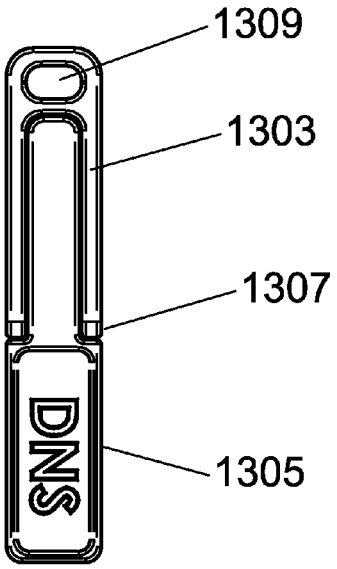
FIG. 15 is a plan view of the hinged zipper pull.
Figure 16:
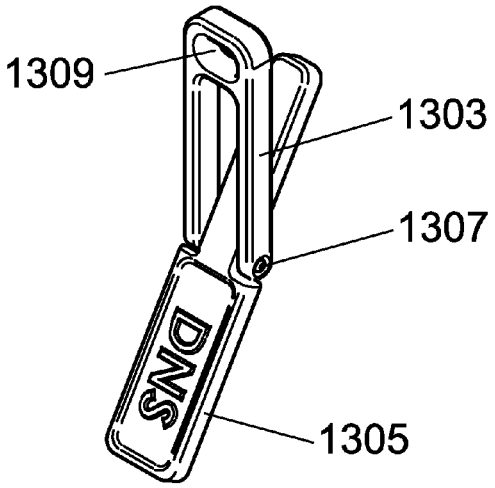
FIG. 16 is a perspective view of the hinged zipper pull in a hinged position.

In another embodiment of the present invention, a hinged zipper pull is provided as depicted in FIGS. 13-16. FIG. 13 is a perspective view of the Self-Aligning Zipper with a hinged zipper pull 1301. The hinged zipper pull 1301 comprises an upper element 1303 and a lower element 1305 connected with a hinge pin 1307 to allow the two elements to move freely, providing an easy to grasp pull. A retainer 1309 is also depicted in FIG. 13 that provides attachment of the hinged zipper pull 1301 to the pull tab 115 on the slider body 113. FIG. 14 is a perspective view of the hinged zipper pull. FIG. 15 is a plan view of the hinged zipper pull and FIG. 16 is a perspective view of the hinged zipper pull in a hinged position. Other zipper pulls may also be used with the Self-Aligning Zipper without departing from the spirit and broad scope of the present invention as described and depicted herein.

For a complete understanding of how to make and use the Self-Aligning Zipper, a complete series of views of the first lower body 101 and the second lower body 103 will be depicted by way of FIGS. 17-28. The views do not include the magnets or the track and tape structures. The magnets during assembly are inserted into the first lower body and the second lower body such that opposite poles face each other, providing an attractive force on each lower body respectively.

Figure 17:
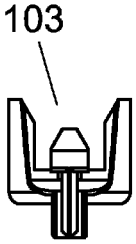
FIG. 17 is a top end view of the second lower body.
Figure 19:
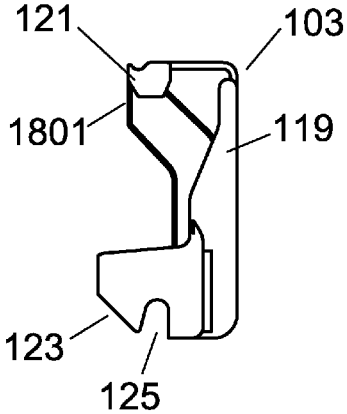
FIG. 19 is a plan view of the second lower body.
Figure 20:
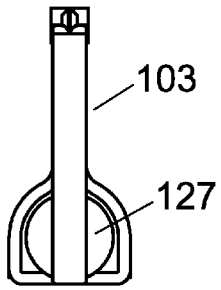
FIG. 20 is a magnet side view of the second lower body.
Figure 21:
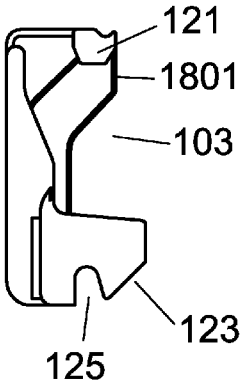
FIG. 21 is an alternate plan view of the second lower body.
Figure 22:
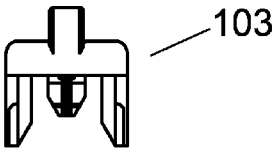
FIG. 22 is a bottom end view of the second lower body.

FIGS. 17-22 depict views of the second lower body. FIG. 17 is a top end view of the second lower body. FIG. 18 is a perspective view of the second lower body. In FIG. 18, an edge 1801 can be seen that aligns and mates with a slot 2403 that can be seen in FIG. 24. Also depicted in FIG. 18 is a second alignment feature 1803 that cooperatively engages with a first alignment feature 2405 depicted in FIG. 24 to allow for easy lead in of the two zipper halves in use, and closes the space between the two zipper halves. The first alignment feature 2405 and the second alignment feature 1803 may, in some embodiments of the present invention, be keyed or otherwise shaped to mate together, for example, using angles or curves that fit together when the two zipper halves are in proper position. FIG. 19 is a plan view of the second lower body. FIG. 20 is a magnet side view of the second lower body. FIG. 21 is an alternate plan view of the second lower body and FIG. 22 is a bottom end view of the second lower body.

Figure 23:
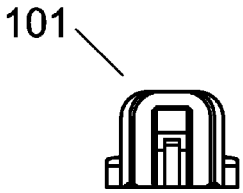
FIG. 23 is a top end view of the first lower body.
Figure 25:
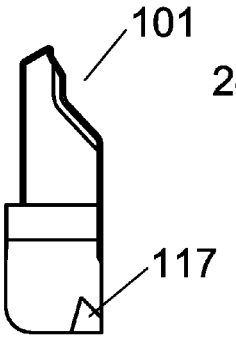
FIG. 25 is a plan view of the first lower body.
Figure 26:
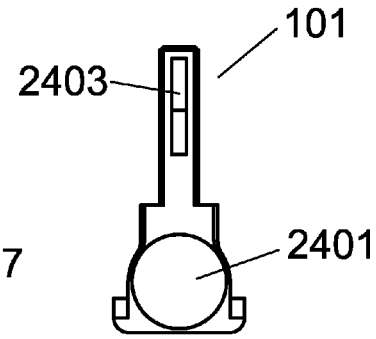
FIG. 26 is a magnet side view of the first lower body.
Figure 27:
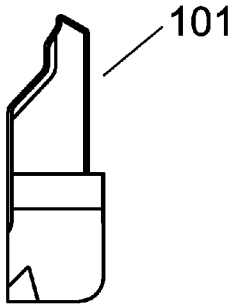
FIG. 27 is an alternate plan view of the first lower body.
Figure 28:
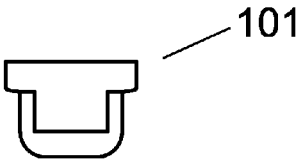
FIG. 28 is a bottom end view of the first lower body.

FIGS. 23-28 depict views of the first lower body. FIG. 23 is a top end view of the first lower body. FIG. 24 is a perspective view of the first lower body. FIG. 24 depicts a slot 2403 that engages with an edge 1801 as depicted in FIG. 18. In addition, a first alignment feature 2405 cooperatively engages with a second alignment feature 1803 as depicted in FIG. 18 to allow for easy lead in of the two zipper halves in use. FIG. 25 is a plan view of the first lower body. FIG. 26 is a magnet side view of the first lower body. FIG. 27 is an alternate plan view of the first lower body and FIG. 28 is a bottom end view of the first lower body.

Figure 29:
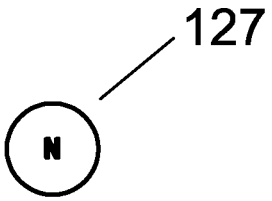
FIG. 29 is a plan view of the first magnet.
Figure 30:
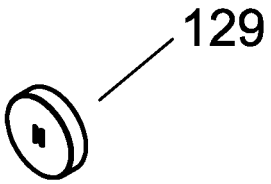
FIG. 30 is a perspective view of the second magnet.

FIG. 29 is a plan view of the first magnet 127 and FIG. 30 is a perspective view of the second magnet 129. As depicted, the magnet is shown as a cylinder. Other geometries may also be used with appropriate modifications to the first lower body and the second lower body structures. The first magnet 127 and the second magnet 129 may be ferrite magnets, alnico magnets, rare earth magnets (Neodymium, Samaritan-cobalt, for example), or the like. In use, opposite poles face each other to provide an attractive force that serves to draw each zipper half together.

Figure 31:
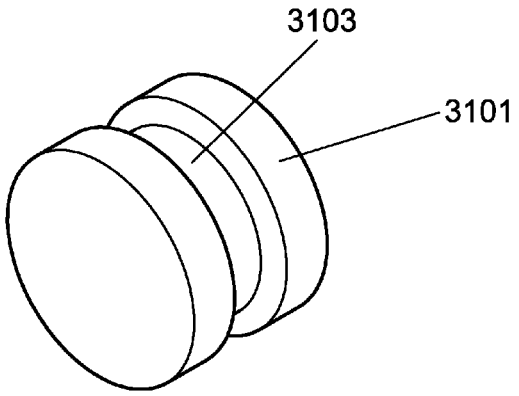
FIG. 31 is a perspective view of a grooved magnet.
Figure 32:
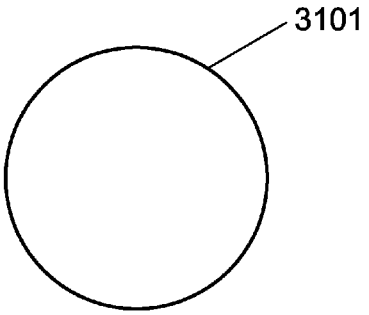
FIG. 32 is a plan view of the grooved magnet of FIG. 31.
Figure 33:
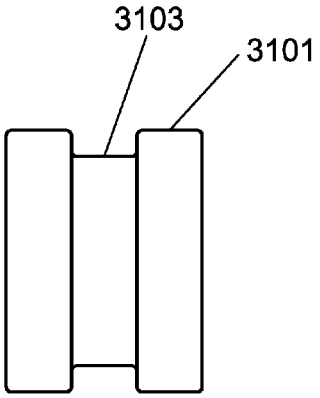
FIG. 33 is a side view of the grooved magnet of FIG. 31.
Figure 34:
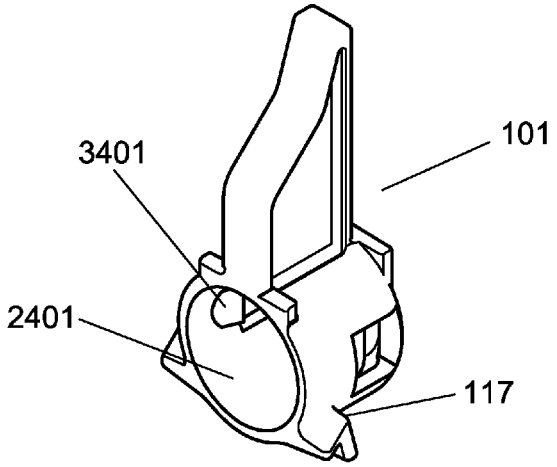
FIG. 34 is a perspective view of the first lower body having clips to retain a grooved magnet.
Figure 35:
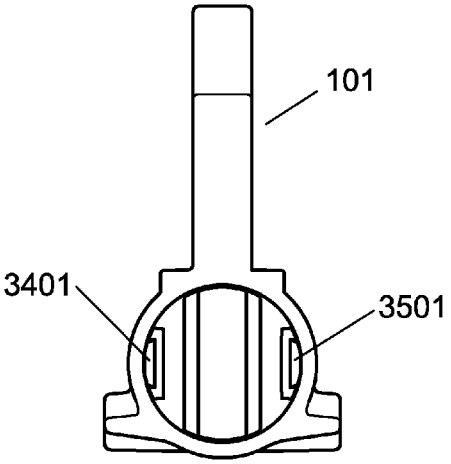
FIG. 35 is a plan view of the first lower body of FIG. 34.
Figure 36:
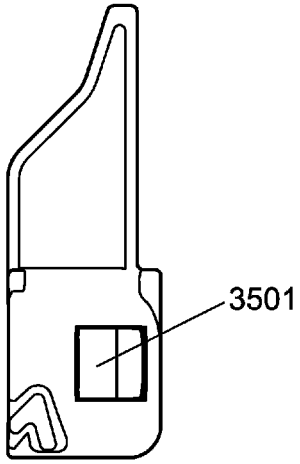
FIG. 36 is a side view of the first lower body of FIG. 34.
Figure 37:
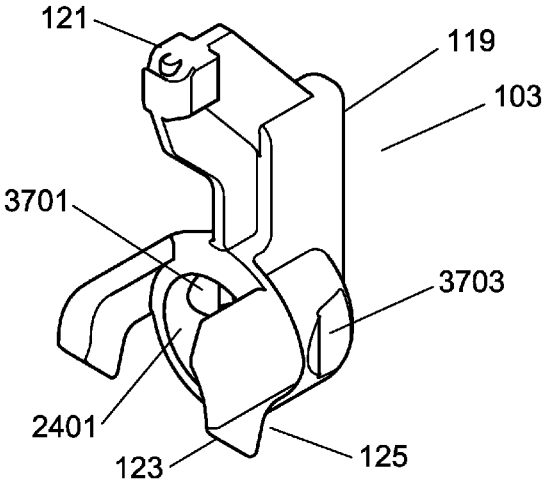
FIG. 37 is a perspective view of the second lower body having clips to retain a grooved magnet.
Figure 38:
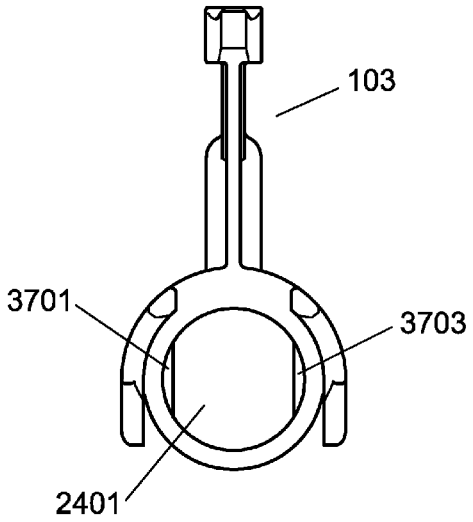
FIG. 38 is a plan view of the second lower body of FIG. 37.
Figure 39:
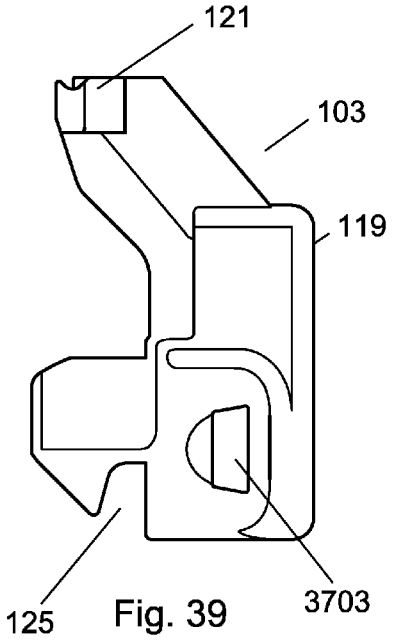
FIG. 39 is a side view of the second lower body of FIG. 37.

In an alternative embodiment of the present invention, the first magnet and the second magnet have a groove such as the grooved magnet 3101 shown in FIGS. 31-33. FIG. 31 is a perspective view of a grooved magnet, FIG. 32 is a plan view of the grooved magnet of FIG. 31, and FIG. 33 is a side view of the grooved magnet of FIG. 31. The groove 3101 is circumferential to the grooved magnet 3101. The groove 3101 interacts with various features in the first lower body and the second lower body to retain the grooved magnet 3101. In this example, the grooved magnet 3101 replaces the first magnet 127 and the second magnet 129 in construction of the Self-Aligning Zipper. The advantage of a grooved or otherwise modified magnet is in the interaction with various features of the first lower body and the second lower body to facilitate magnet retention. Examples include the use of clips, dowels, rods, and the like. For example, FIGS. 34-39 depict the use of internal catches to engage with or otherwise mechanically retain the grooved magnet. FIG. 34 is a perspective view of the first lower body having clips to retain a grooved magnet. A first catch 3401 can be seen in FIG. 34, while a second catch 3501 and the first catch 3401 can be seen in FIG. 35. FIG. 35 is a plan view of the first lower body of FIG. 34 and FIG. 36 is a side view of the first lower body of FIG. 34. The first catch 3401 and the second catch 3501 may be formed of the same material as the first lower body and the second lower body, or may be a different material. The first catch 3401 and the second catch 3501 may be rectangular, triangular, square, or the like, and may, in some embodiments of the present invention, be deformable, pliable, or otherwise resilient to allow the grooved magnet to be retained by such an arrangement through contact with the groove in the magnet. The second lower body 103 may also employ a similar arrangement where a first catch 3701 and a second catch 3703 are used to retain the grooved magnet, thus allowing the magnet to snap in during assembly and not come out. FIG. 37 is a perspective view of the second lower body having clips to retain a grooved magnet. FIG. 38 is a plan view of the second lower body of FIG. 37. FIG. 39 is a side view of the second lower body of FIG. 37. The first catch 3701 and the second catch 3703 may be formed of the same material as the second lower body and the first lower body, or may be a different material. The first catch 3701 and the second catch 3703 may be rectangular, triangular, square, or the like, and may, in some embodiments of the present invention, be deformable, pliable, or otherwise resilient to allow the grooved magnet to be retained by such an arrangement through contact with the groove in the magnet. During assembly, the grooved magnet is pressed into the magnet retainer 2401 where the clips pass by the grooved magnet circumference until engaging with, and being retained by, the groove in the magnet.

Figure 40:
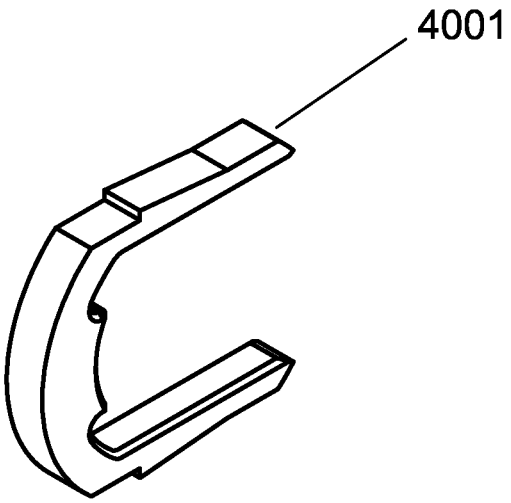
FIG. 40 is a perspective view of a u-clip.
Figure 41:
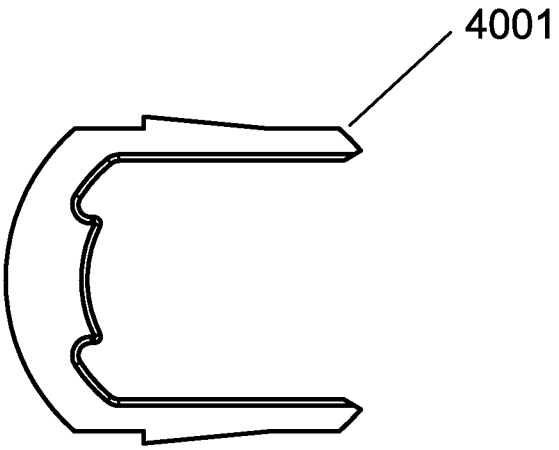
FIG. 41 is a plan view of the u-clip of FIG. 40.
Figure 42:
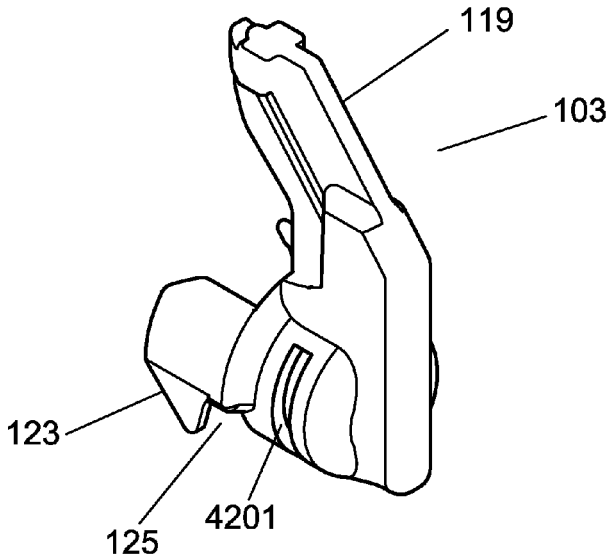
FIG. 42 is a perspective view of the second lower body having a receiver structure for a u-clip.
Figure 43:
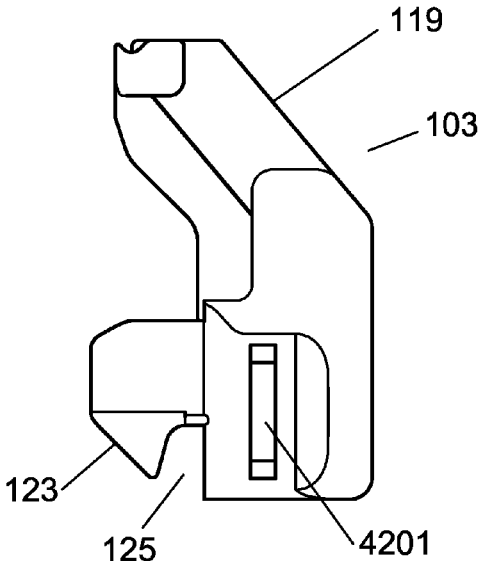
FIG. 43 is a side view of the second lower body of FIG. 42.
Figure 44:
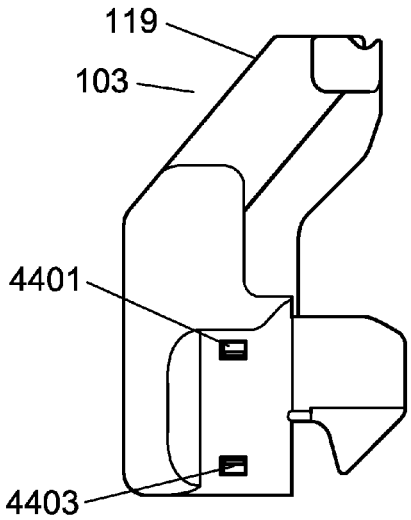
FIG. 44 is an opposite side view of the second lower body of FIG. 42.
Figure 45:
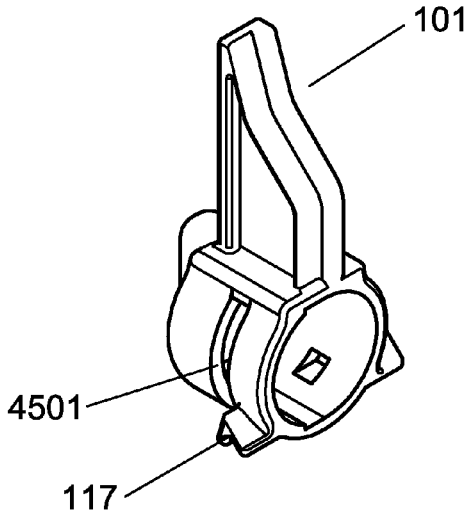
FIG. 45 is a perspective view of the first lower body having a receiver structure for a u-clip.
Figure 46:
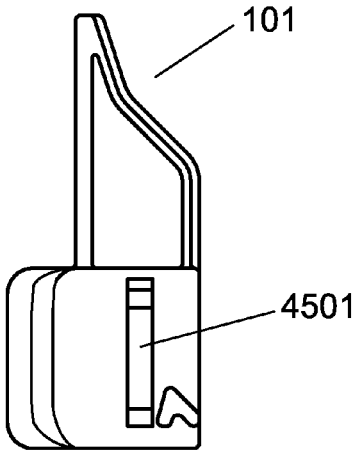
FIG. 46 is a side view of the first lower body of FIG. 45.
Figure 47:
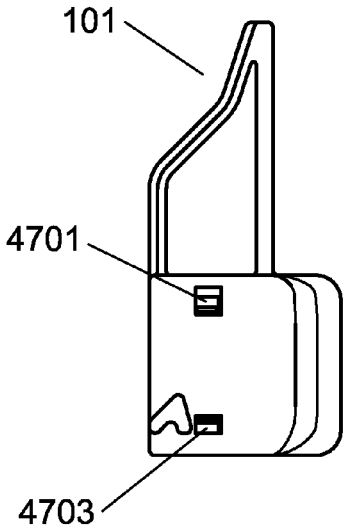
FIG. 47 is an opposite side view of the first lower body of FIG. 45.

In another embodiment of the present invention, a u-clip is employed to pass through the first lower body and thus retain the magnet through retention of the u-clip by the groove in the grooved magnet. Such an arrangement may also be employed with the second lower body. The grooved magnet 3101 can be seen in FIGS. 31-33. FIG. 40 is a perspective view of a u-clip 4001. The u-clip may have ridges, notches, grooves, or other characteristics to engage with openings in the first lower body or second lower body. FIG. 41 is a plan view of the u-clip of FIG. 40 showing such features as well as a generally raised and curvilinear feature contained within the u shape of the clip that serves to capture and retain the magnet. FIG. 42 is a perspective view of the second lower body having a receiver structure for a u-clip. Depicted on the one side of the second lower body is a slot where the u-clip passes during assembly. FIG. 43 is a side view of the second lower body of FIG. 42. FIG. 44 is an opposite side view of the second lower body of FIG. 42. On the opposite side of the second lower body 103 are a first u-clip receiver 4401 and a second u-clip receiver 4403 that are essentially holes that serve to retain the u-clip 4001. These holes may be square, rectangular, circular, or other such shape that coincides with the structure of the u-clip 4001 to facilitate retention. In a similar manner, the first lower body 101 may employ a u-clip for magnet retention. FIG. 45 is a perspective view of the first lower body having a receiver structure for a u-clip. A slot 4501 can be seen where the u-clip passes during assembly. FIG. 46 is a side view of the first lower body of FIG. 45. FIG. 47 is an opposite side view of the first lower body of FIG. 45. On the opposite side of the first lower body 101 are a first u-clip receiver 4701 and a second u-clip receiver 4703 that are essentially holes that serve to retain the u-clip 4001. These holes may be square, rectangular, circular, or other such shape that coincides with the structure of the u-clip 4001 to facilitate retention. While the u-clip 4001 is depicted as being inserted from the side of each lower body, in some embodiments of the present invention it may be inserted from the bottom, top, or from an angle.

Figure 48:
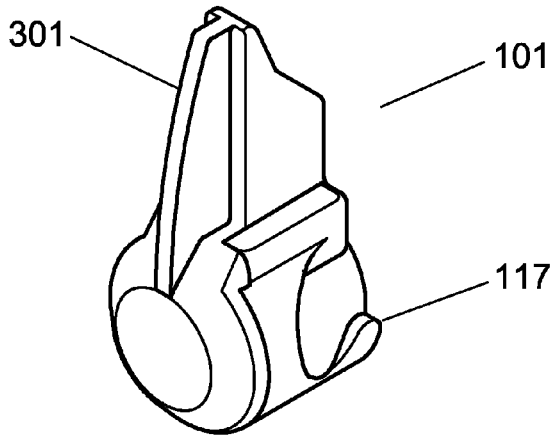
FIG. 48 is a perspective view of another embodiment of the first lower body.
Figure 49:
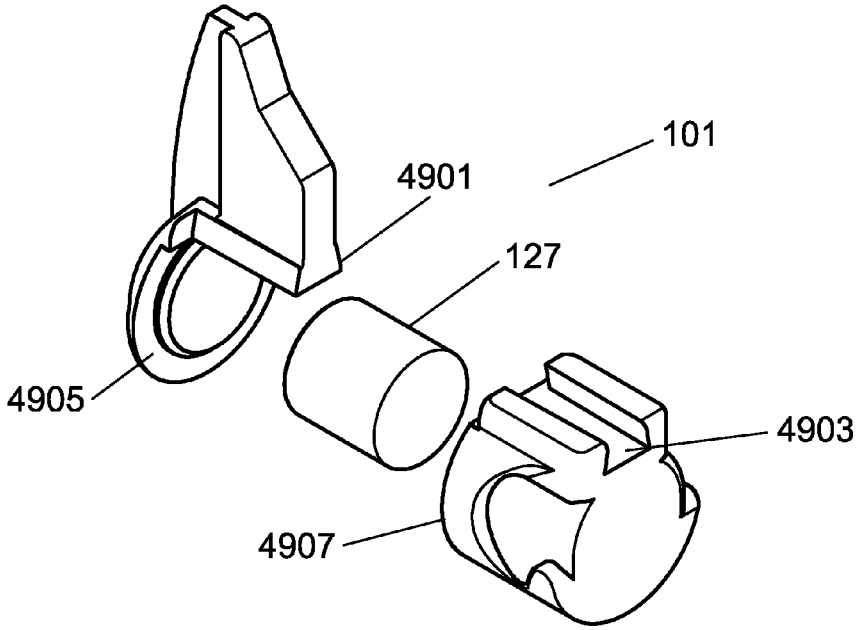
FIG. 49 is an exploded view of the first lower body of FIG. 48.

Other techniques for magnet retention include a secondary part that is molded or formed with each lower body and folds over and snaps in place, either from the back or the front (contacting) surface of the magnet. In addition, in some embodiments of the present invention, each lower body may be made in multiple pieces, with the magnet inserted between or within the pieces and then each of the various pieces being joined together using an adhesive, a weld, a fastener, or the like. For example, the first lower body and the second lower body may be made in two pieces, with features such as a guide and a guide receiver used to facilitate joining of the two pieces. In FIGS. 48-52, an exemplary embodiment of such a multiple piece arrangement is shown. FIG. 48 is a perspective view of another embodiment of the first lower body 101. In FIGS. 48 and 49, some of the attributes of the first lower body 101 have been rounded to provide for a more aesthetically pleasing look. For example, the first extension 301 and the male retention element 117 afford rounded features, but are still in keeping with the spirit and broad scope of the present invention as described and envisioned herein. FIG. 49 depicts an exploded view of the first lower body 101 of FIG. 48 where a first section 4905 and a second section 4907 are depicted. The first section 4905 and the second section 4907 serve to retain the first magnet 127, and may have additional features such as a guide 4901 and a guide receiver 4903 that act to join the first section 4905 and the second section 4907 together during assembly (final manufacturing). The guide 4901 may be a rail like structure that may have a beveled edge or several beveled edges to provide retention in the guide receiver 4903. The guide receiver 4903 has features that are mates to the features on guide 4901, such as chamfered inner surfaces to mate with and receive the chamfered or beveled edges of the guide 4901. If the chamfer is angled outward with respect to the guide receiver opening, the two parts (the first section 4905 and the second section 4907) are held together when assembled. Other guiding structures such as the concentric raised feature shown on 4905 that mates with the magnet opening in the second section 4907 may also be employed in some embodiments of the present invention. In addition, catches, ridges or other retaining features may be employed in the guide, guide receiver, or mating surfaces of the first section and the second section to allow for retention and secure mating of each section during assembly and prior to application of additional joining techniques such as adhesives, heat or plastic welding. Once the first section 4905 and the second section 4907 are assembled with the first magnet 127 retained within the two sections, they may be further joined together using adhesives, fasteners, heat or plastic welding. In some embodiments of the present invention, the first magnet 127 is further adhered to, fused, or bonded to either the first section 4905, the second section 4907, or both.

Figure 50:
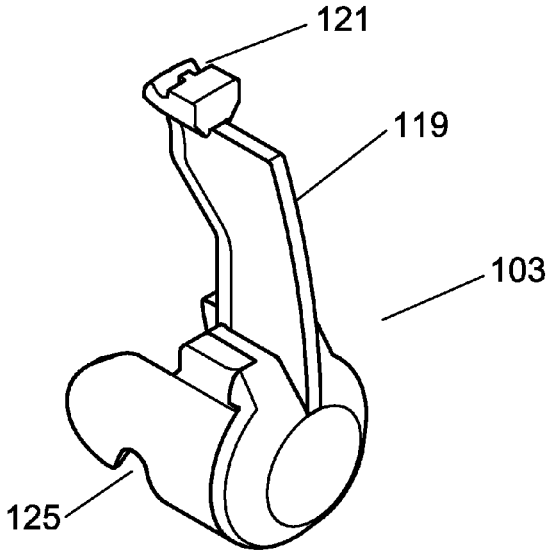
FIG. 50 is a perspective view of another embodiment of the second lower body.
Figure 51:
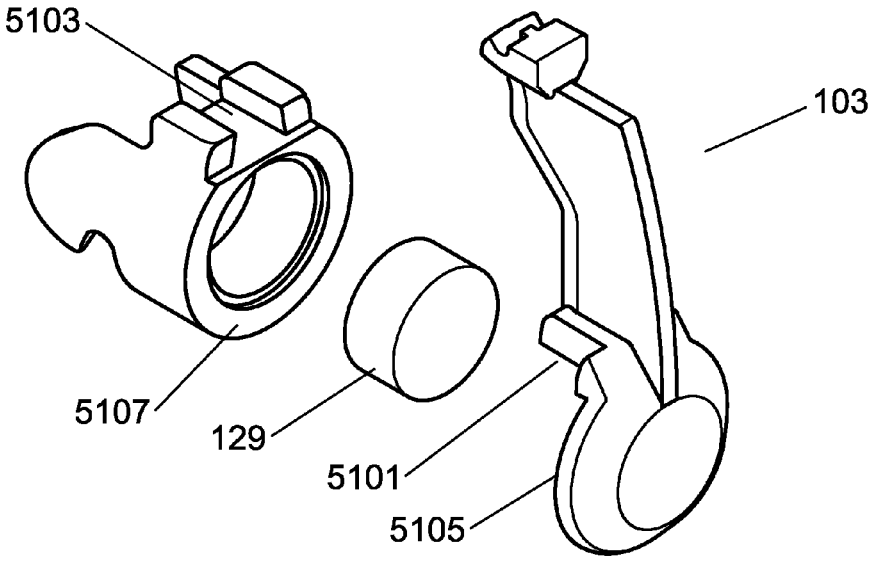
FIG. 51 is an exploded view of the second lower body of FIG. 50.

FIG. 50 is a perspective view of another embodiment of the second lower body 103. Similar to that of FIGS. 48 and 49, some of the attributes of the second lower body 103 have been rounded to provide for a more aesthetically pleasing look. For example, the second extension 119 and the female retention element 125 afford rounded features, but are still in keeping with the spirit and broad scope of the present invention as described and envisioned herein. FIG. 51 depicts an exploded view of the second lower body 103 of FIG. 50 where a first section 5105 and a second section 5107 are depicted. The first section 5105 and the second section 5107 serve to retain the second magnet 129 when assembled, and may have additional features such as a guide 5101 and a guide receiver 5103 that act to join the first section 5105 and the second section 5107 together during assembly (final manufacturing). The guide 5101 may be a rail like structure that may have a beveled edge or several beveled edges to provide retention in the guide receiver 5103. The guide receiver 5103 has features that are mates to the features on guide 5101, such as chamfered inner surfaces to mate with and receive the chamfered or beveled edges of the guide 5101. If the chamfer is angled outward with respect to the guide receiver opening, the two parts (the first section 5105 and the second section 5107) are held together when assembled. Other guiding structures such as a concentric raised feature on 5105 that mates with the magnet opening in the second section 5107 may also be employed in some embodiments of the present invention. In addition, catches, ridges or other retaining features may be employed in the guide, guide receiver, or mating surfaces of the first section and the second section to allow for retention and secure mating of each section during assembly and prior to application of additional joining techniques such as adhesives, heat or plastic welding. Once the first section 5105 and the second section 5107 are assembled with the second magnet 129 retained within the two sections, they may be further joined together using adhesives, fasteners, heat or plastic welding. In some embodiments of the present invention, the second magnet 129 is further adhered to, fused, or bonded to either the first section 5105, the second section 5107, or both.

Figure 52:
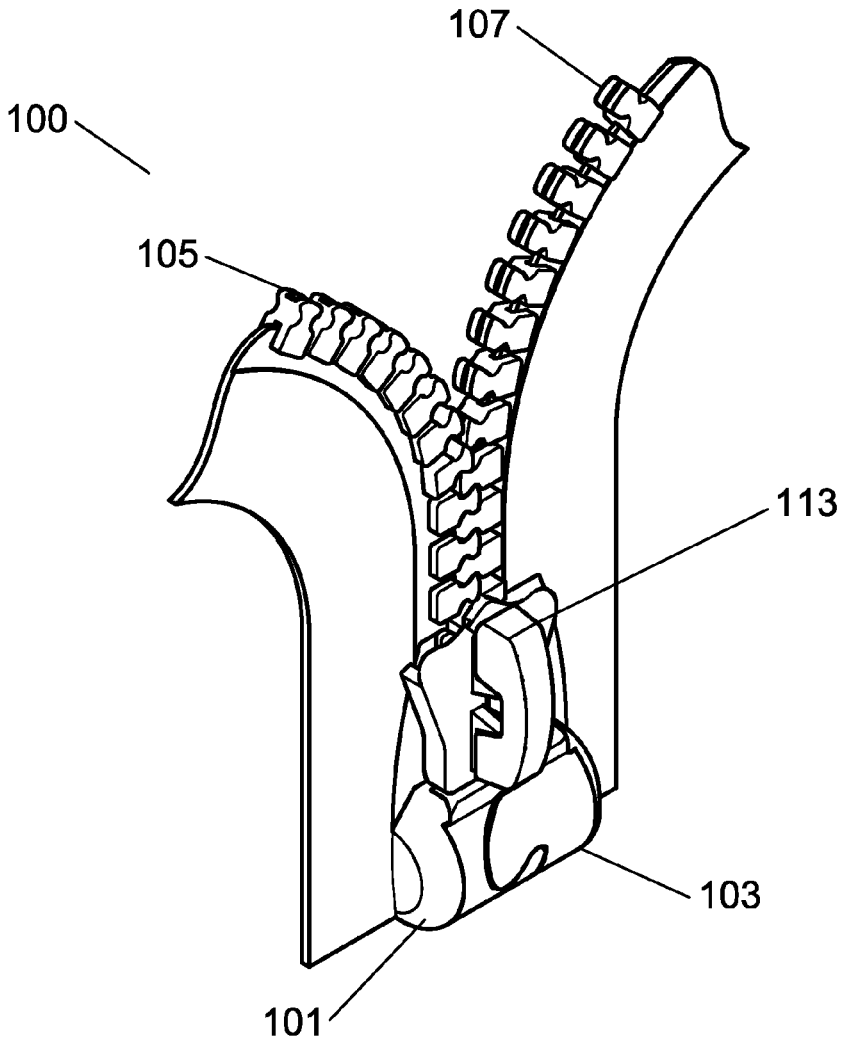
FIG. 52 is a perspective view of another embodiment of the Self-Aligning Zipper once joined (zipper pull not shown for clarity).

FIG. 52 is a perspective view of another embodiment of the Self-Aligning Zipper where the zipper pull is not shown for clarity. The Self-Aligning Zipper 100 depicted in FIG. 52 employs the first lower body 101 and the second lower body 103 depleted and described in FIGS. 48-51. A first zipper track 105 and a second zipper track 107 can be seen along with a slider body 113. Of course a zipper pull such as the zipper pulls previously described and depicted herein would be attached to the slider body 113 in use, but has been omitted from FIG. 52 for clarity.

To operate the Self-Aligning Zipper, the two halves of the Self-Aligning Zipper are placed near each other such that the magnets in each of the two lower bodies attract each other and draw the two sides together. As the two lower bodies make contact, the alignment geometries such as the angled face, the male retention element and the female retention element form an aligned and proper fit of the two zipper halves, and the zipper pull is moved along the length of the zipper, causing closure of the zipper.

It is, therefore, apparent that there has been provided, in accordance with the various objects of the present invention, a Self-Aligning Zipper. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the present invention as defined by this specification, claims, and the attached drawings.

What is claimed is:

1. A fastening device, the fastening device comprising:
- a first lower body comprising a first magnet, a male retention element and a first extension;
- a first zipper track having a plurality of teeth and retained by the first lower body;
- a second lower body comprising a second magnet, a female retention element and a second extension;
- a second zipper track having a plurality of teeth and retained by the second lower body;
- a slider body;
- the female retention element of the second lower body having a notch to receive the male retention element of the first lower body and an angled face to guide the female retention element of the second lower body into proper alignment with the male retention element of the first lower body through the attractive force of the first magnet and the second magnet.

2. The fastening device of claim 1, wherein said first or second magnet comprises a least partly of a ferromagnetic material.

3. The fastening device of claim 1, wherein said first or second magnet are grooved.

4. The fastening device of claim 3, further comprising a u-clip for retention of the first magnet.

5. The fastening device of claim 3, further comprising a u-clip for retention of the second magnet.

6. The fastening device of claim 3, wherein said first lower body further comprises a first catch and a second catch for retention of the first magnet.

7. The fastening device of claim 3, wherein said second lower body further comprises a first catch and a second catch for retention of the second magnet.

8. The fastening device of claim 1, wherein said first lower body further comprises a first alignment feature.

9. The fastening device of claim 1, wherein said second lower body further comprises a second alignment feature.

10. A self-aligning zipper for one handed operation, the self-aligning zipper comprising:
- a first lower body comprising a first magnet, a male retention element and a first extension;
- a first zipper track having a plurality of teeth and affixed to the first lower body;
- a slider body slidably connected to the first zipper track;
- a second lower body comprising a second magnet, a female retention element and a second extension;
- a second zipper track having a plurality of teeth and affixed to the second lower body;
- the female retention element of the second lower body having a notch to receive the male retention element of the first lower body and an angled face to guide the female retention element of the second lower body into proper alignment with the male retention element of the first lower body through the attractive force of the first magnet and the second magnet.

11. The self-aligning zipper of claim 10, further comprising a starter tooth affixed to the second lower body.

12. The self-aligning zipper of claim 10, wherein said first or second magnet comprises at least partly of a ferromagnetic material.

13. The self-aligning zipper of claim 10, wherein said first or second magnet are grooved.

14. The self-aligning zipper of claim 13, further comprising a u-clip for retention of the first magnet.

15. The self-aligning zipper of claim 13, further comprising a u-clip for retention of the second magnet.

16. The self-aligning zipper of claim 13, wherein said first lower body further comprises a first catch and a second catch for retention of the first magnet.

17. The self-aligning zipper of claim 13, wherein said second lower body further comprises a first catch and a second catch for retention of the second magnet.

18. The self-aligning, zipper of claim 10, wherein said first lower body further comprises a first alignment feature.

19. The self-aligning zipper of claim 10, wherein said second lower body further comprises a second alignment feature.

20. A self-aligning zipper for one handed operation, the self-aligning zipper comprising:
- a first lower body comprising a first magnet, a male retention element and a first extension;
- a first zipper track having a plurality of teeth and affixed to the first lower body;
- a second lower body comprising a second magnet, a female retention element and a second extension;
- a second zipper track having a plurality of teeth and affixed to the second lower body;
- a slider body slidably connected to the second zipper track;
- the female retention element of the second lower body having a notch to receive the male retention element of the first lower body and an angled face to guide the female retention element of the second lower body into proper alignment with the male retention element of the first lower body through the attractive force of the first magnet and the second magnet.

21. The self-aligning zipper of claim 20, further comprising a starter tooth affixed to the first lower body.

22. The self-aligning zipper of claim 20, wherein said first or second magnet comprises at least partly of a ferromagnetic material.

23. The self-aligning zipper of claim 20, wherein said first or second magnet are grooved.

24. The self-aligning zipper of claim 23, further comprising a u-clip for retention of the first magnet.

25. The self-aligning zipper of claim 23, further comprising a u-clip for retention of the second magnet.

26. The self-aligning zipper of claim 23, wherein said first lower body further comprises a first catch and a second catch for retention of the first magnet.

27. The self-aligning zipper of claim 23, wherein said second lower body further comprises a first catch and a second catch for retention of the second magnet.

28. The self-aligning zipper of claim 23, wherein said first lower body further comprises a first alignment feature.

29. The self-aligning zipper of claim 23, wherein said second lower body further comprises a second alignment feature.

30. A fastening device, the fastening device comprising:

a first lower body comprising a first magnet, a male retention element and a first extension, the first lower body being made in two sections where the first section and the second section are joined together to retain the first magnet;

a second lower body comprising as second magnet, a female retention element and a second extension, the second lower body being made in two sections where the first section and the second section are joined together to retain the second magnet;

the female retention element of the second lower body having a notch to receive the male retention element of the first lower body and an angled face to guide the female retention element of the second lower body into proper alignment with the male retention element of the first lower body through the attractive force of the first magnet and the second magnet.

31. The fastening device of claim 30, wherein said first or second magnet comprises a least partly of a ferromagnetic material.

32. The fastening device of claim 30, wherein said first lower body further comprises a first alignment feature.

33. The fastening device of claim 30, wherein said second lower body further comprises a second alignment feature.

* * * * *